US008839473B1

(12) United States Patent
Catala

(10) Patent No.: US 8,839,473 B1
(45) Date of Patent: Sep. 23, 2014

(54) AIR MATTRESS COMFORT ADJUSTMENT SYSTEM

(71) Applicant: Alex Catala, Jamaica, NY (US)

(72) Inventor: Alex Catala, Jamaica, NY (US)

( * ) Notice: Subject to any disclaimer, the term of this patent is extended or adjusted under 35 U.S.C. 154(b) by 52 days.

(21) Appl. No.: 13/675,517

(22) Filed: Nov. 13, 2012

(51) Int. Cl.
*F15D 1/00* (2006.01)
*A47C 27/08* (2006.01)

(52) U.S. Cl.
CPC ..... *A47C 27/083* (2013.01)
USPC ..... 5/707; 5/706; 5/708

(58) Field of Classification Search
None
See application file for complete search history.

(56) References Cited

U.S. PATENT DOCUMENTS

| | | | | |
|---|---|---|---|---|
| 5,425,147 | A | 6/1995 | Supplee et al. | |
| 5,848,450 | A | 12/1998 | Oexman et al. | |
| 6,047,423 | A | 4/2000 | Larson | |
| 6,058,537 | A | 5/2000 | Larson | |
| 6,253,401 | B1 | 7/2001 | Boyd | |
| 6,421,858 | B1 | 7/2002 | Cuerel | |
| 6,686,711 | B2 * | 2/2004 | Rose et al. | 318/16 |
| 7,036,171 | B2 | 5/2006 | Wu | |
| D537,287 | S | 2/2007 | Lau | |
| 7,437,787 | B2 | 10/2008 | Bhai | |
| 8,087,113 | B2 | 1/2012 | Roff et al. | |
| 8,090,478 | B2 | 1/2012 | Skinner et al. | |
| 8,156,589 | B2 | 4/2012 | Liu et al. | |
| 8,162,009 | B2 | 4/2012 | Chaffee | |
| 8,413,278 | B2 * | 4/2013 | Chaffee | 5/713 |
| 2009/0314354 | A1 * | 12/2009 | Chaffee | 137/14 |
| 2010/0293715 | A1 * | 11/2010 | Sakamoto et al. | 5/423 |
| 2011/0041246 | A1 * | 2/2011 | Li et al. | 5/421 |
| 2011/0289684 | A1 * | 12/2011 | Parish et al. | 5/421 |
| 2012/0017376 | A1 * | 1/2012 | Mikkelsen et al. | 5/726 |
| 2012/0110734 | A1 * | 5/2012 | An | 5/423 |
| 2012/0304385 | A1 * | 12/2012 | Ishibashi et al. | 5/613 |
| 2014/0007346 | A1 * | 1/2014 | Lachenbruch | 5/421 |

* cited by examiner

*Primary Examiner* — William Kelleher

(57) ABSTRACT

A system, a device and a method for maintaining a consistent preset inflation of an air mattress inflated using a device having at least one sensor sensing relative humidity and temperature, and a controller activating a pump in response to a change in the ambient air condition, the sensor communicating to the controller, the controller selectively activating the pump in response to the change, the pump inflating the mattress to the preset inflation, maintaining consistent inflation of the air mattress. In one embodiment, the sensor communicates the ambient air condition to the controller wirelessly. The sensor is coupled to the controller and the controller is coupled to the pump operative to pump air into the mattress, the controller operative to activate the pump in response to the change in an ambient air condition, maintaining consistent inflation of the air mattress at the preset inflation chosen for comfort.

5 Claims, 4 Drawing Sheets

AIR MATTRESS COMFORT ADJUSTMENT SYSTEM

TECHNICAL FIELD

The present disclosure relates generally to an air mattress comfort adjustment system. More particularly, the present disclosure relates to an air mattress comfort adjustment system that responds to environmental conditions and adjusts the air in the air mattress for maximum comfort.

BACKGROUND

Air mattresses provide supplemental beds for house guests, convert the back of a station wagon, van or flat bed truck into sleeping quarters and provide a comfortable bed in a tent when camping. Air mattresses generally are temporary beds, although some may prefer an air mattress to a waterbed or a traditional mattress.

Air mattresses are inflated by air pumps. Users choose a level of inflation that they find most comfortable, each user having a preferred level of resilience and firmness determining the level of inflation. The user desires that the air mattress maintains the level of inflation set for comfort throughout the period of use.

Many have proposed load cells to adjust the level of inflation based on the weight or the position of the user. Others propose having multiple cells within the mattress to provide a customized fit to a particular user.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a system for maintaining a consistent inflation of an air mattress. Accordingly, an aspect of an example embodiment in the present disclosure provides a controller to activate an pump to maintain a consistent inflation of an mattress.

Another aspect of an example embodiment in the present disclosure is to provide a system for maintaining a consistent inflation of an air mattress in response to changes in an ambient air condition. Accordingly, an aspect of an example embodiment in the present disclosure provides a controller to activate an pump to maintain a consistent inflation of an mattress in response to a change in the ambient air condition.

A further aspect of an example embodiment in the present disclosure is to provide a system for maintaining a consistent inflation of an air mattress by monitoring a change in an ambient air condition. Accordingly, an aspect of an example embodiment in the present disclosure provides at least one sensor operative to sense an ambient air condition, the sensor communicating to a controller, the controller activating a pump to maintain a consistent inflation of an mattress in response to a change in the ambient air condition.

Yet another aspect of an example embodiment in the present disclosure is to provide a system for maintaining a consistent inflation of an air mattress in response to a change in an ambient air condition. Accordingly, an aspect of an example embodiment in the present disclosure provides a controller that determines an amount of air required to maintain consistent inflation of the mattress in response to a signal of a change in the ambient air condition, activates a mattress pump, determines an amount of air the pump has added to the mattress and selectively deactivates the pump when the amount of air the pump has added to the mattress equals the amount of air required to maintain consistent inflation of the mattress.

The present disclosure describes a system, a device and a method for maintaining a consistent preset inflation of an air mattress inflated by a pump using a device having at least one sensor sensing an ambient air condition, such as relative humidity and temperature, and a controller operative to activate the pump in response to a change in the ambient air condition, the sensor sensing the ambient air condition and communicating to the controller, the controller selectively activating the pump in response to the change in the condition, the pump inflating the mattress to the preset inflation, maintaining consistent inflation of the air mattress at the preset inflation chosen for comfort. In one embodiment, the sensor communicates the ambient air condition to the controller wirelessly. The sensor is coupled to the controller and the controller is coupled to the pump operative to pump air into the mattress, the controller operative to activate the pump in response to the change in an ambient air condition, maintaining consistent inflation of the air mattress at the preset inflation chosen for comfort.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1A:
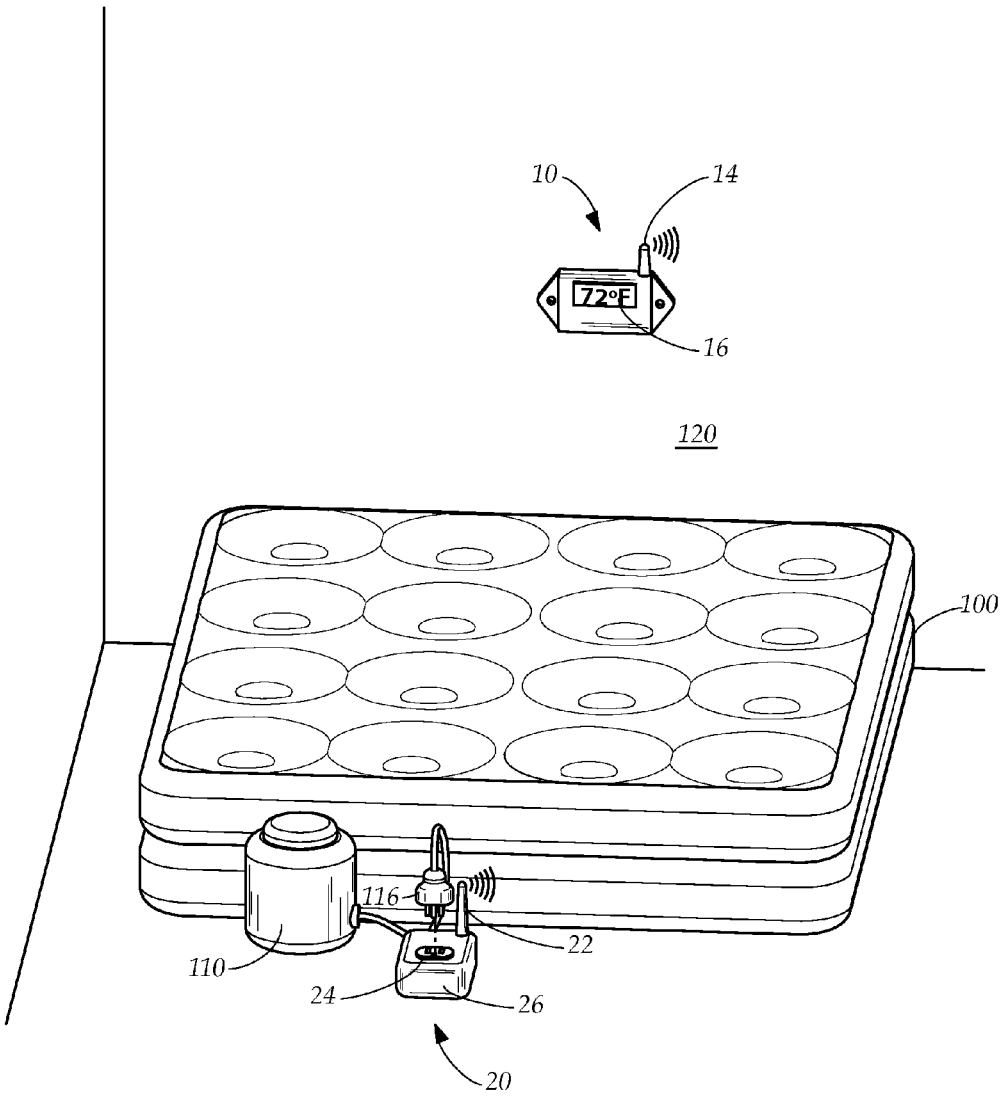
FIG. 1A is a diagrammatic perspective view of a sensor and a controller coupled to a pump for inflating an air mattress.

FIG. 1A illustrates a system for maintaining a consistent inflation of an inflatable air mattress 100. A user chooses the inflation for comfort, selecting a level of preferred firmness and resilience. The system has the air mattress coupled to a pump 110, the pump operative to pump air into the mattress, inflating the mattress to the chosen inflation initially, establishing a pre-set inflation to be maintained. The pre-set inflation is the inflation chosen for comfort. The system has device having a controller 20 and at least one sensor 10 sensing an ambient air condition.

While it is understood by those of ordinary skill, that the air pumped into a mattress is not an ideal gas as explained by thermodynamic relationship of the ideal gas law, ambient air generally follows the principle that a change in ambient conditions, such as temperature, effects volume and pressure of an air containing system. Like a balloon, the volume of the air in the mattress will increase with an increase in temperature and decrease with a decrease in temperature. When an air mattress is used in a setting such as camping, either in a tent, back of a vehicle or outdoors, the temperature can change twenty or thirty degrees overnight while the mattress is in use. The mattress will lose volume and become less firm.

In another example, when the mattress is used inside, a rise in relative humidity can increase the ambient air pressure, causing the mattress to increase in volume, becoming firmer.

The controller is operative to activate the pump in response to a change in the ambient air condition. The sensor 10 senses the ambient air condition and communicates to the controller 20. The controller selectively activates the pump in response to the change in the condition, the pump 110 inflating the mattress to the preset inflation, maintaining consistent inflation of the air mattress at the preset inflation chosen for comfort.

In one embodiment, the controller 20 determines an amount of air required to maintain consistent inflation of the mattress in response to the change in the ambient air condition, determines an amount of air the pump has added to the mattress and selectively deactivates the pump when the amount of air the pump has added to the mattress equals the amount of air required to maintain consistent inflation of the mattress.

In one example embodiment, the sensor has a display 16. As illustrated in FIG. 1A, the sensor monitors and displays the ambient air condition in the display. The sensor 10 is mounted on a vertical structure 120 adjacent to the mattress. When the system is used inside a building, the vertical structure is an interior wall; when the system is deployed outside a building, the vertical structure is, for example, but not restricted to a vehicle wall, a tent wall or even a tree, a post or even a rock.

In one example embodiment, the sensor 10 communicates the ambient air condition to the controller wirelessly. In the illustration, the sensor has a wireless transmitter 14, shown by an antenna and a wireless symbol. The controller has a wireless receiver 22 for receiving the communication from the sensor. The antennas and wireless symbols are for the purpose of illustration, symbolizing wireless communication and not a limitation of the embodiment. It is well known to those of ordinary skill that an antenna is not required for wireless communication.

In the illustrated example, the pump 110 having a plug 116 on a cord 112 couples to the controller 20 by inserting the plug 116 into a socket 24. The controller switches the pump on and off by selectively supplying power to the pump. In this example embodiment, the controller has a housing 26 that contains a power source. In other embodiments, the controller 20 connects to AC current. In still other embodiments, the controller wirelessly couples to the pump, switching the pump on and off by wireless communication. Coupling and powering pumps by controllers is well known to those of ordinary skill and further example embodiments are beyond the scope of this discussion. The example embodiments presented are not intended to be limitations but enabling examples embodiments.

Figure 1B:
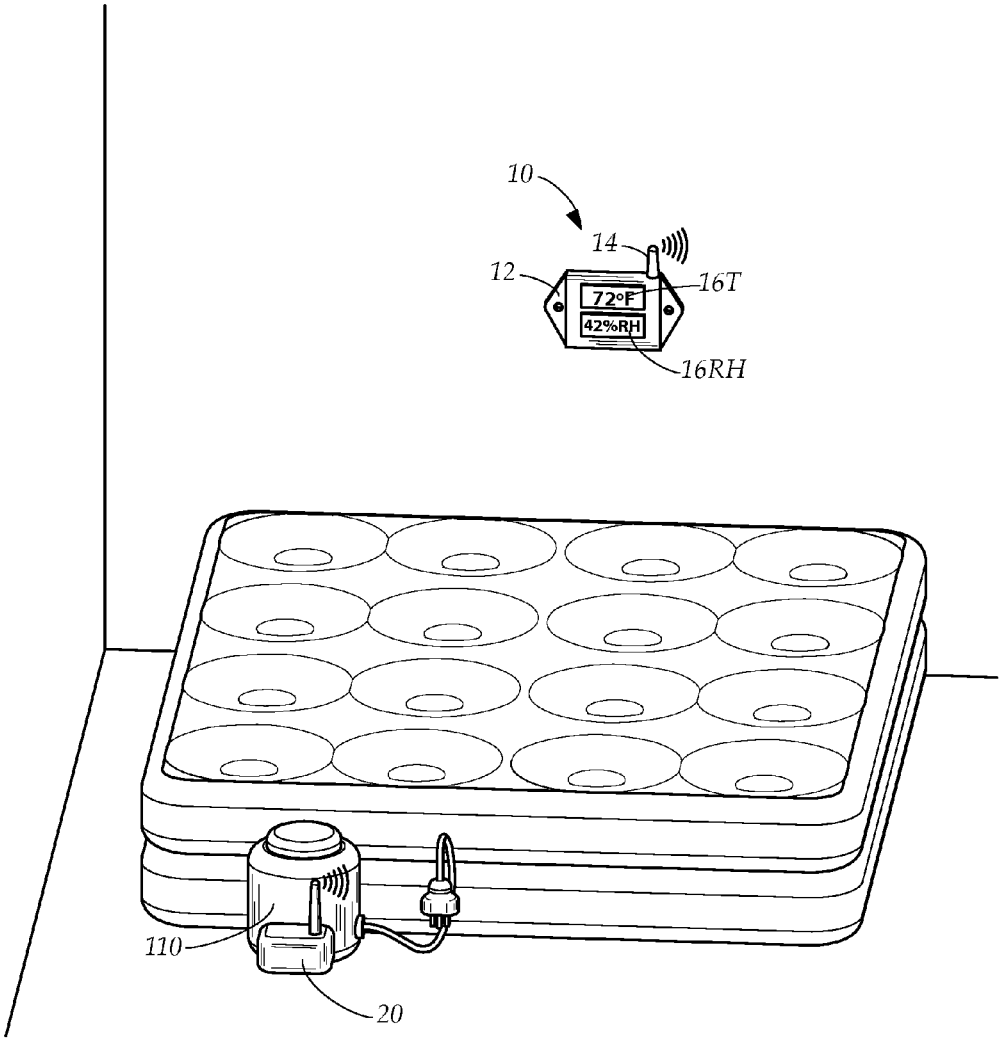
FIG. 1B, similar to FIG. 1A, is a diagrammatic perspective view of a further embodiment of the sensor and the controller coupled to the pump for inflating the air mattress.

FIG. 1B illustrates another example embodiment of the system. In the illustration, the device includes the pump 110, the controller 20 integral to the pump 110. In the illustration, the pump is powered by AC current as enabling non-limiting example embodiment.

FIG. 1B shows a plurality of sensors 10 in a housing 12. In the drawing, the housing has a temperature sensor and a relative humidity sensor. The housing has a temperature display 16T displaying a temperature reading and a relative humidity display 16RH displaying a relative humidity reading. Temperature and relative humidity readings are transmitted to the controller by the wireless transmitter 14 as explained hereinabove.

Figure 2:
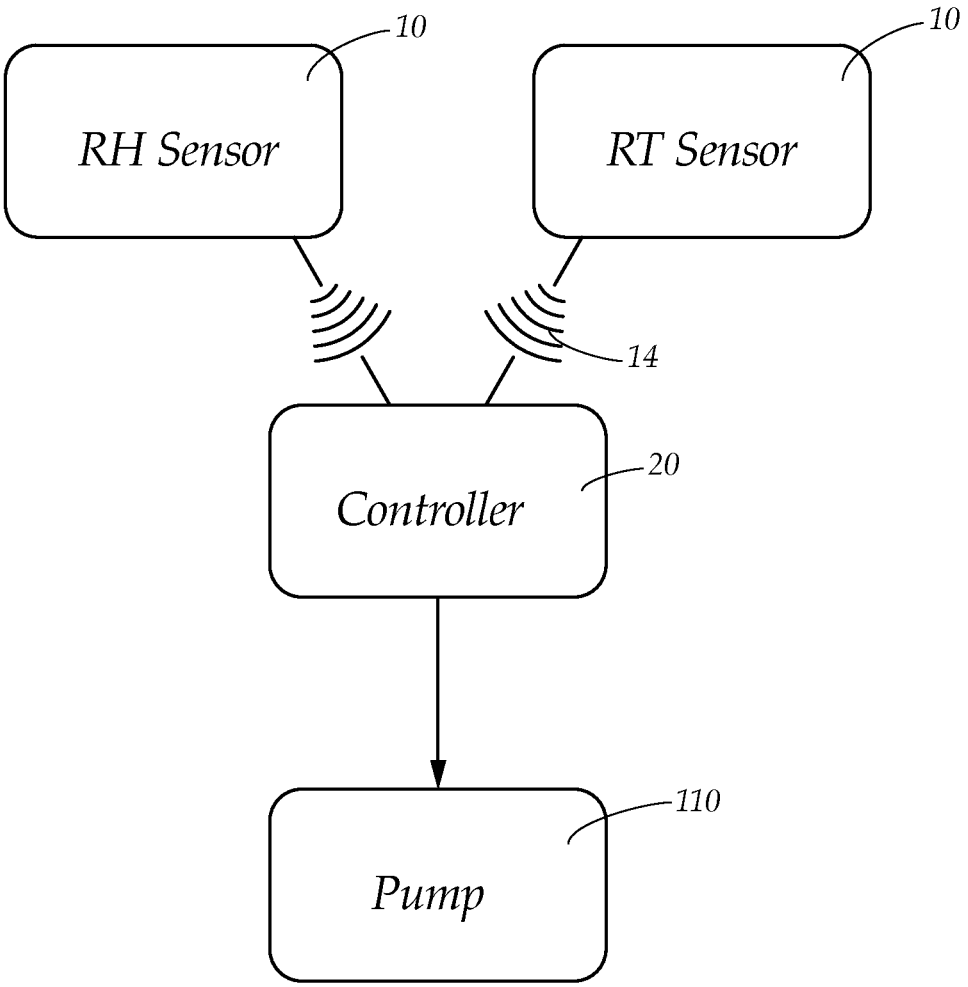
FIG. 2 is a block diagram of the method for maintaining a consistent inflation of the air mattress.

FIG. 2 illustrates a block diagram of a method for maintaining the consistent inflation of the air mattress. The at least one sensor 10, sensing the ambient air condition couples to the controller 20, the sensor sensing the ambient air condition and communicating the condition to the controller and the pump 110 operative to pump air into the mattress is coupled to a controller operative to activate the pump in response to a change in an ambient air condition, the pump inflating the mattress to a preset inflation, maintaining consistent inflation of the air mattress at the preset inflation for comfort. The at least one sensor 10 communicates the ambient air condition to the controller wirelessly 14. In the illustrated example embodiment of the method, a plurality of sensors selectively couple to the controller.

The step of coupling at least one sensor sensing the ambient air condition to a controller includes the step of the controller determining an amount of air required to maintain consistent inflation of the mattress in response to the change in the ambient air condition, determining an amount of air the pump has added to the mattress and determining when the amount of air the pump has added to the mattress equals the amount of air required to maintain consistent inflation of the mattress.

The step of coupling the pump 110 operative to pump air into the mattress to the controller 20 operative to activate the pump 110 in response to a change in the ambient air condition includes the controller selectively activating the pump in response to the change in the condition, the pump inflating the mattress to the preset inflation and selectively deactivating the pump when the amount of air the pump has added to the mattress equals the amount of air required to maintain consistent inflation of the mattress at the preset inflation chosen for comfort.

Figure 3:
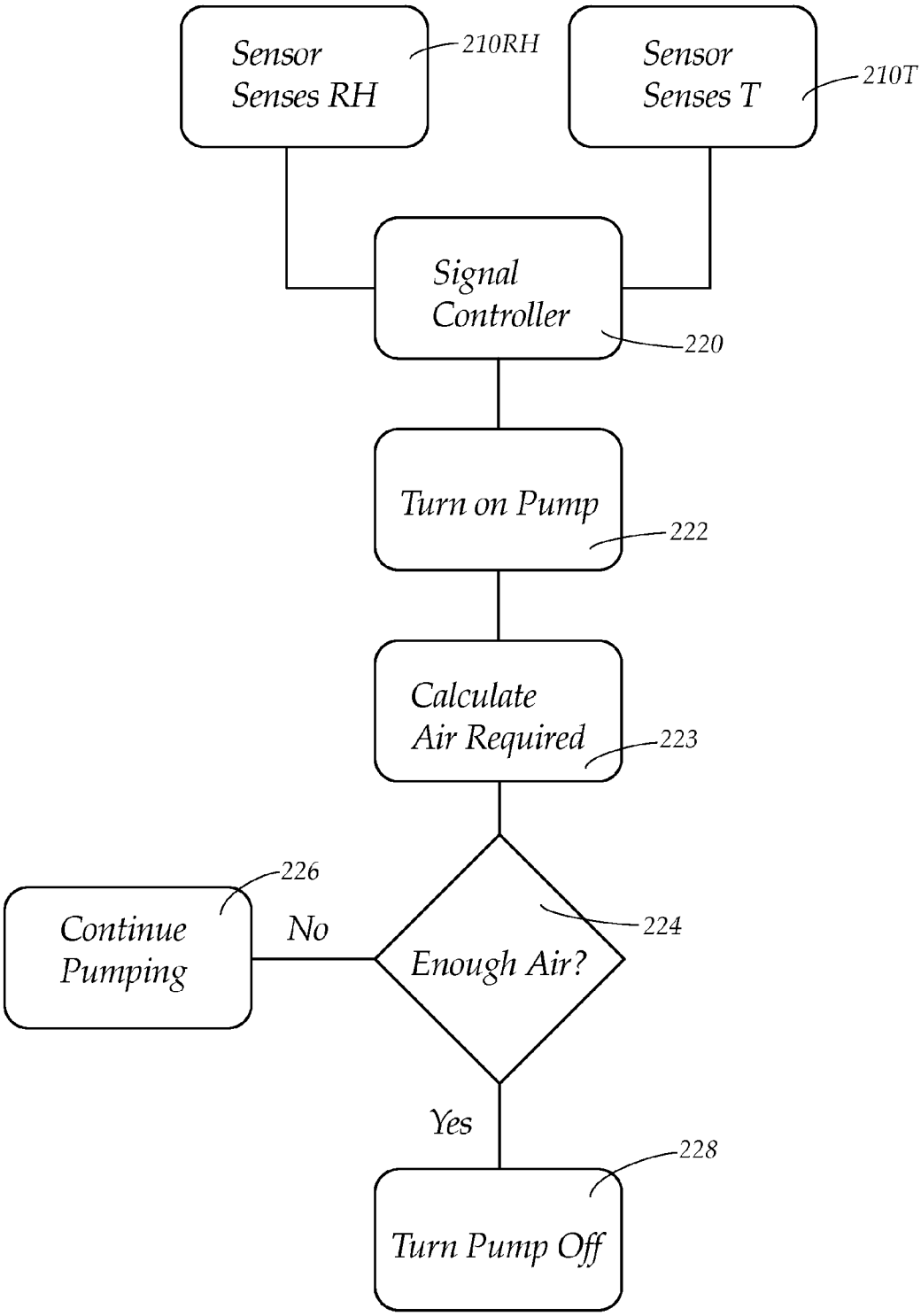
FIG. 3 is a flow chart of the method for maintaining a consistent inflation of the air mattress.

FIG. 3 illustrates a flow chart for the system operation. The sensor of the system senses an ambient air condition, in one embodiment, the ambient relative humidity 210RH and in another embodiment, the ambient temperature 210T. The sensor signals the controller 220. The controller of the system determines that there is a change in ambient air condition. The controller of the system turns on the pump 222. The controller of the system calculates the air required. The controller of the system calculates if the pump has added enough air 224. If enough air has been added to maintain consistent inflation of the mattress at the preset inflation chosen for comfort, the controller of the system turns the pump off 226. If not enough air has not been added to maintain consistent inflation of the mattress at the preset inflation chosen for comfort, the controller does not turn the pump off, the pump continues pumping 228.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an air mattress comfort adjustment system that responds to environmental conditions and adjusts the air in the air mattress for maximum comfort. The disclosure is illustrated by example in the drawing figures, and throughout the written description. It should be understood that numerous variations are possible, while adhering to the inventive concept. Such variations are contemplated as being a part of the present disclosure.

What is claimed is:

1. A system for maintaining a consistent inflation of an air mattress, the inflation chosen for comfort, comprising:
- an inflatable air mattress;
- a pump operative to pump air into the mattress, inflating the mattress to a preset inflation;
- at least one sensor sensing an ambient air condition, the sensor mounted on a vertical structure nearby to said mattress;
- a, the controller having a socket operative to connect to the pump, the controller operative to activate the pump in response to a change in the ambient air condition, the sensor sensing the ambient air condition and wirelessly communicating to the controller, the controller selectively activating the pump in response to the change in the condition, the pump inflating the mattress to the preset inflation, maintaining consistent inflation of the air mattress at the preset inflation chosen for comfort.

2. The system as described in claim 1, wherein the ambient air condition sensed by the at least one sensor is relative humidity.

3. A device for controlling a pump, the pump operative to inflate an air mattress, the device maintaining a consistent inflation of the air mattress, the device comprising:
- at least one sensor operative to sense an ambient air condition occurring where an air mattress is placed, the sensor mounted on a vertical structure nearby to said mattress;
- a controller, the controller having a socket operative to connect to the pump, the controller operative to activate the pump in response to a change in the ambient air condition, the sensor sensing the ambient air condition and wirelessly communicating to the controller, the controller selectively activating the pump in response to the change in the condition, the pump inflating the mattress to the preset inflation, maintaining consistent inflation of the air mattress at the preset inflation chosen for comfort.

4. The device as described in claim 3, wherein the ambient air condition sensed by the at least one sensor is relative humidity.

5. A method for maintaining a consistent inflation of an air mattress chosen for comfort, comprising:
- coupling at least one sensor sensing the ambient air condition to a controller, the sensor mounted on a vertical structure nearby to an air mattress; the sensor sensing the ambient air condition and wirelessly communicating the condition to the controller; and
- coupling a pump operative to pump air into a mattress to a controller via a socket on the controller, the controller operative to activate the pump in response to a change in an ambient air condition, the pump inflating the mattress to a preset inflation, maintaining consistent inflation of the air mattress at the preset inflation chosen for comfort.

* * * * *